US008590520B2

(12) United States Patent
Tseng

(10) Patent No.: US 8,590,520 B2
(45) Date of Patent: Nov. 26, 2013

(54) VALVE FOR CONNECTING A GAS CARTRIDGE TO A HOLLOW CONNECTOR IN AN AIR PISTOL

(76) Inventor: Shu-Mei Tseng, New Taipei (TW)

( * ) Notice: Subject to any disclaimer, the term of this patent is extended or adjusted under 35 U.S.C. 154(b) by 107 days.

(21) Appl. No.: 13/444,930

(22) Filed: Apr. 12, 2012

(65) Prior Publication Data

US 2013/0269670 A1 Oct. 17, 2013

(51) Int. Cl.
*F41B 11/00* (2013.01)

(52) U.S. Cl.
USPC ..... 124/74

(58) Field of Classification Search
USPC ..... 124/73–77
See application file for complete search history.

(56) References Cited

U.S. PATENT DOCUMENTS

| | | | | | |
|---|---|---|---|---|---|
| 2,304,320 | A * | 12/1942 | Tratsch | 124/77 |
| 2,554,116 | A * | 5/1951 | Monner | 124/74 |
| 2,594,240 | A * | 4/1952 | Wells | 124/76 |
| 2,845,055 | A * | 7/1958 | Collins et al. | 124/77 |
| 4,094,294 | A * | 6/1978 | Speer | 124/56 |
| 4,215,867 | A * | 8/1980 | Natwick | 273/357 |
| 5,881,707 | A * | 3/1999 | Gardner, Jr. | 124/77 |
| 5,967,133 | A * | 10/1999 | Gardner, Jr. | 124/77 |
| 6,035,843 | A * | 3/2000 | Smith et al. | 124/77 |
| 6,889,681 | B1 * | 5/2005 | Alexander et al. | 124/72 |
| 7,882,830 | B1 * | 2/2011 | Gabrel | 124/73 |
| 7,913,679 | B2 * | 3/2011 | Quinn et al. | 124/77 |
| 7,992,483 | B2 * | 8/2011 | Tseng | 89/130 |
| 8,485,173 | B1 * | 7/2013 | Tseng | 124/73 |
| 2002/0046747 | A1 * | 4/2002 | Colby | 124/73 |

* cited by examiner

*Primary Examiner* — Michael David

(57) ABSTRACT

An air pistol is provided with a gas cartridge including a reservoir and upper internal threads; a valve including lower external threads releasably secured to the internal threads, a lengthwise central channel, an inclined tunnel having one end communicating with the channel and the other end terminated at an outer surface of the valve, and an inverted L-shaped passage communicating with the channel; a spring actuated plunger slidably disposed in the valve and including at least one upper outlet; a sealing member disposed under the plunger and fastened in the channel; and an elongated, hollow connector disposed in the air pistol and inserted into the channel to push the plunger toward the sealing member so as to create a fluid path from the reservoir, the passage, the at least one upper outlet, and the channel to the hollow connector.

2 Claims, 7 Drawing Sheets

VALVE FOR CONNECTING A GAS CARTRIDGE TO A HOLLOW CONNECTOR IN AN AIR PISTOL

BACKGROUND OF THE INVENTION

1. Field of the Invention

The invention relates to air guns and more particularly to an air pistol having a valve for connecting a gas cartridge to a hollow connector in a butt.

2. Description of Related Art

Conventionally, an air pistol fires projectiles by means of compressed air or other gas, or compressed $CO_2$ all stored in a detachable, disposable cylinder (i.e., being not refillable). Such cylinders are intended for single use. And in turn, the use of disposable products had led to a marked increase in trash.

Thus, the need for improvement exists.

SUMMARY OF THE INVENTION

It is therefore one object of the invention to provide an air pistol comprising a gas cartridge comprising a reservoir and upper internal threads; a valve comprising lower external threads releasably secured to the internal threads, a lengthwise central channel, an inclined tunnel having one end communicating with the channel and the other end terminated at an outer surface of the valve, and an inverted L-shaped passage communicating with the channel; a spring actuated plunger slidably disposed in the valve and comprising at least one upper outlet; a sealing member disposed under the plunger and fastened in the channel; and an elongated, hollow connector disposed in the air pistol and inserted into the channel to push the plunger toward the sealing member so as to create a fluid path from the reservoir, the passage, the at least one upper outlet, and the channel to the hollow connector.

The above and other objects, features and advantages of the invention will become apparent from the following detailed description taken with the accompanying drawings.

DETAILED DESCRIPTION OF THE INVENTION

Figure 1:
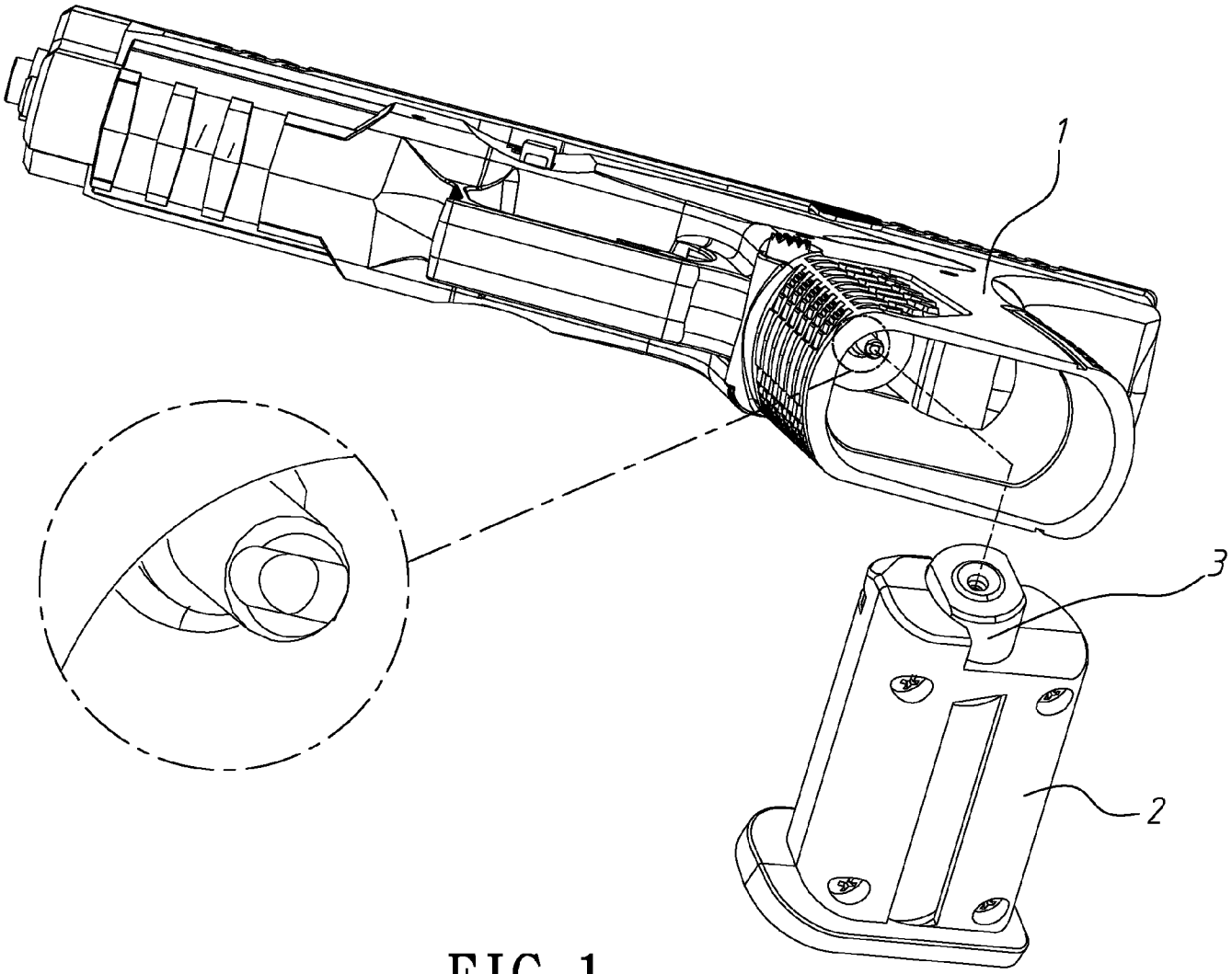
FIG. 1 is an exploded perspective view of an air pistol according to the invention with a gas cartridge detached.
Figure 2:
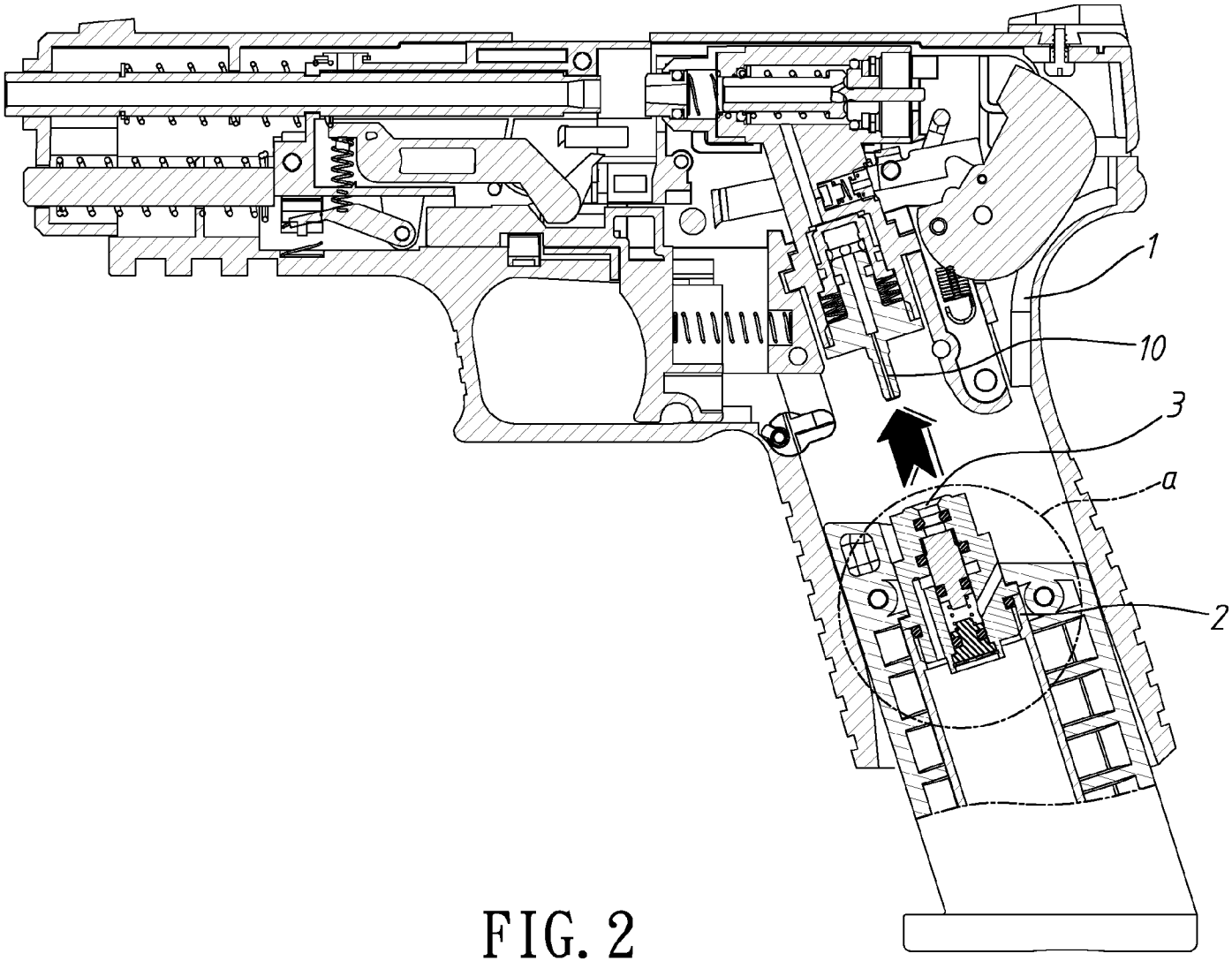
FIG. 2 is a longitudinal sectional view of the air pistol with the gas cartridge being assembled.
Figure 3:
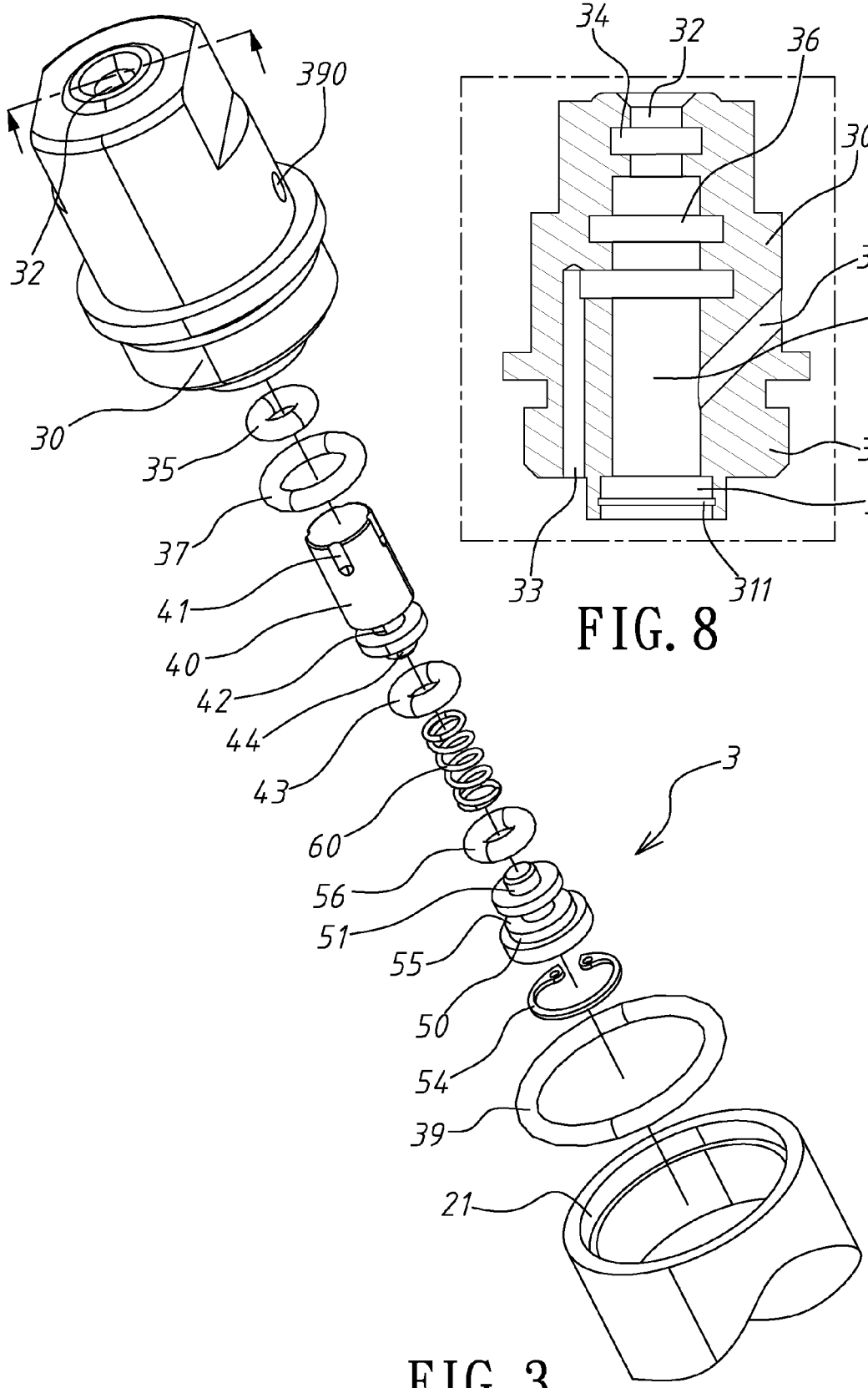
FIG. 3 is an exploded view of the valve and adjacent components.
Figure 8:
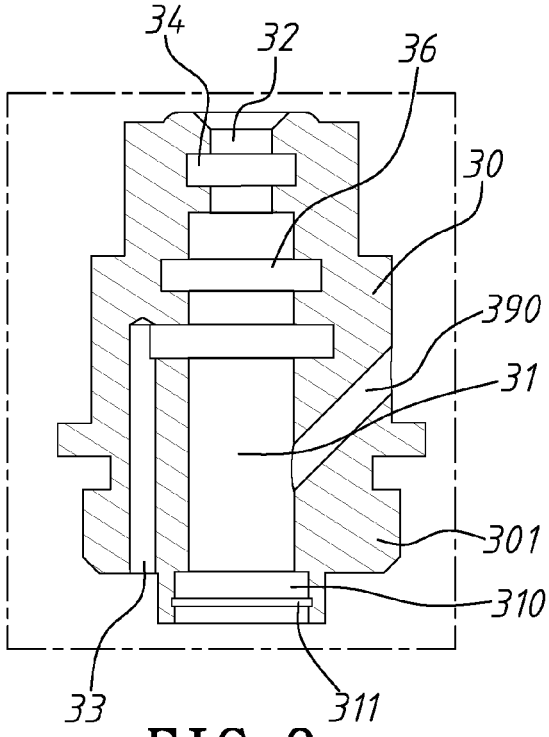
FIG. 8 is a longitudinal sectional view of the housing of the valve.
Figure 4:
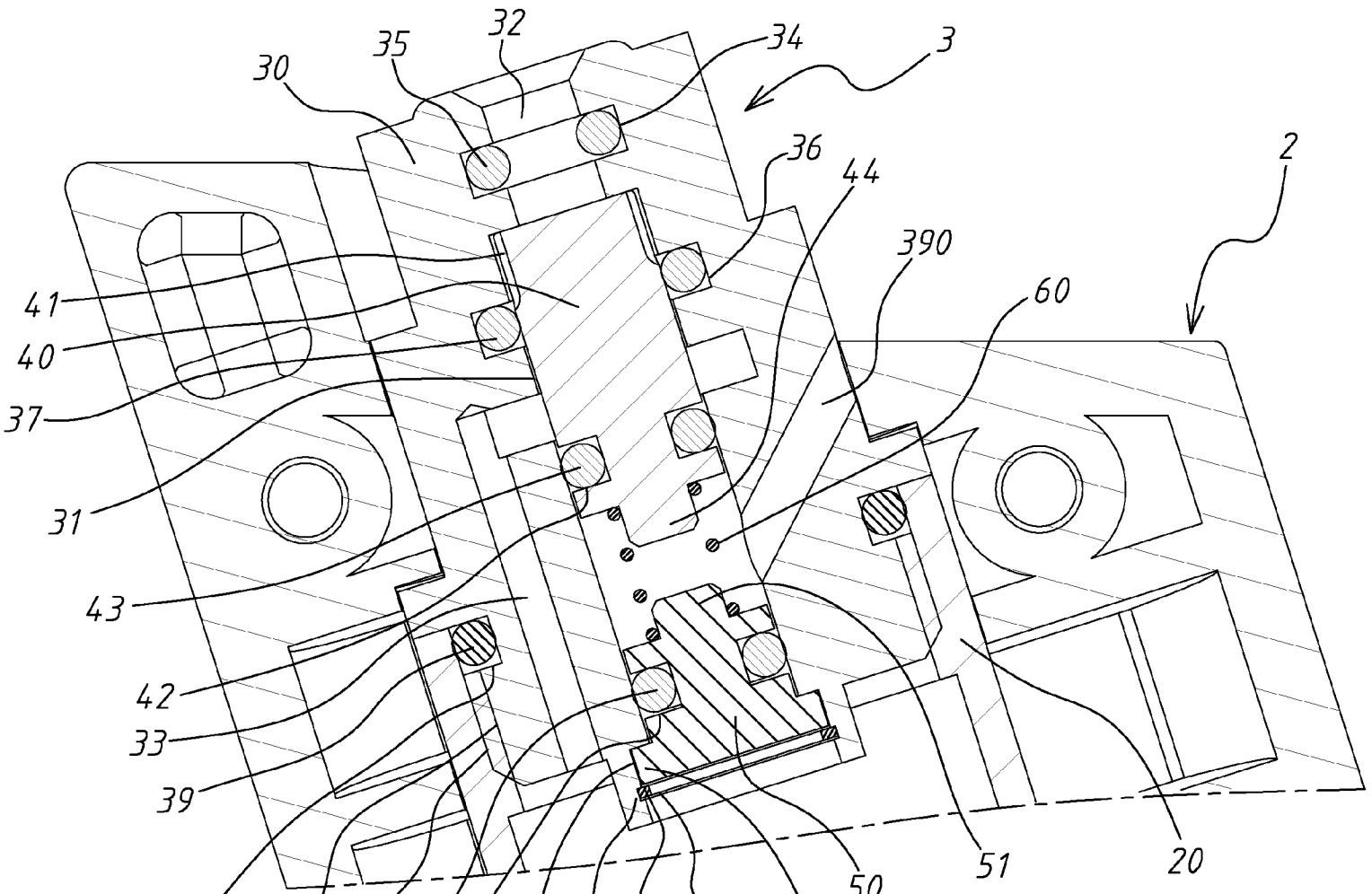
FIG. 4 is a detailed view of the area in circle a in FIG. 2.
Figure 5:
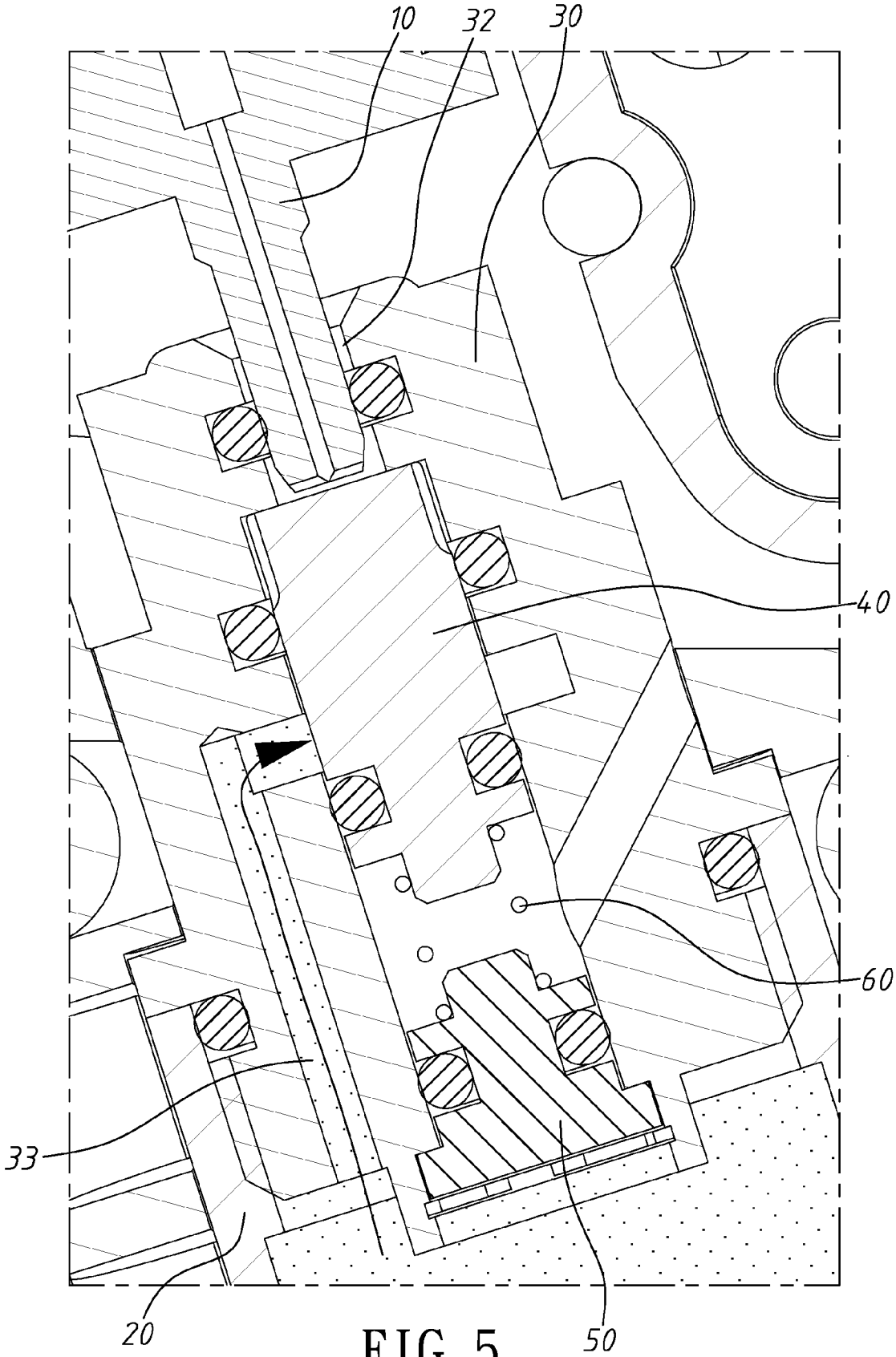
FIG. 5 is an enlarged view of FIG. 4 showing the needle shaped hollow connector inserted into the outlet during assembly.
Figure 6:
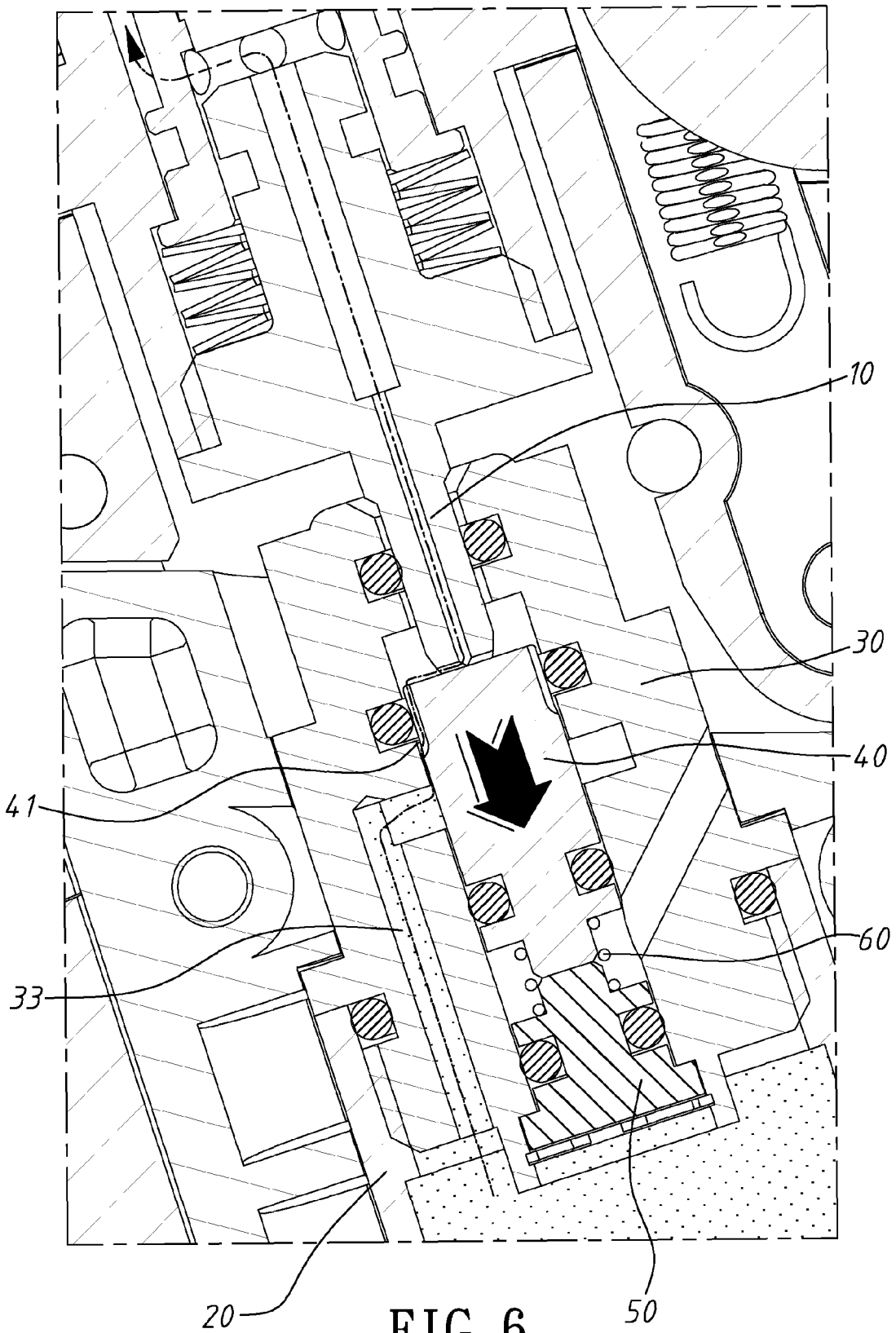
FIG. 6 is a view similar to FIG. 5 showing the hollow connector further inserted into the channel of the valve to create a fluid path.
Figure 7:
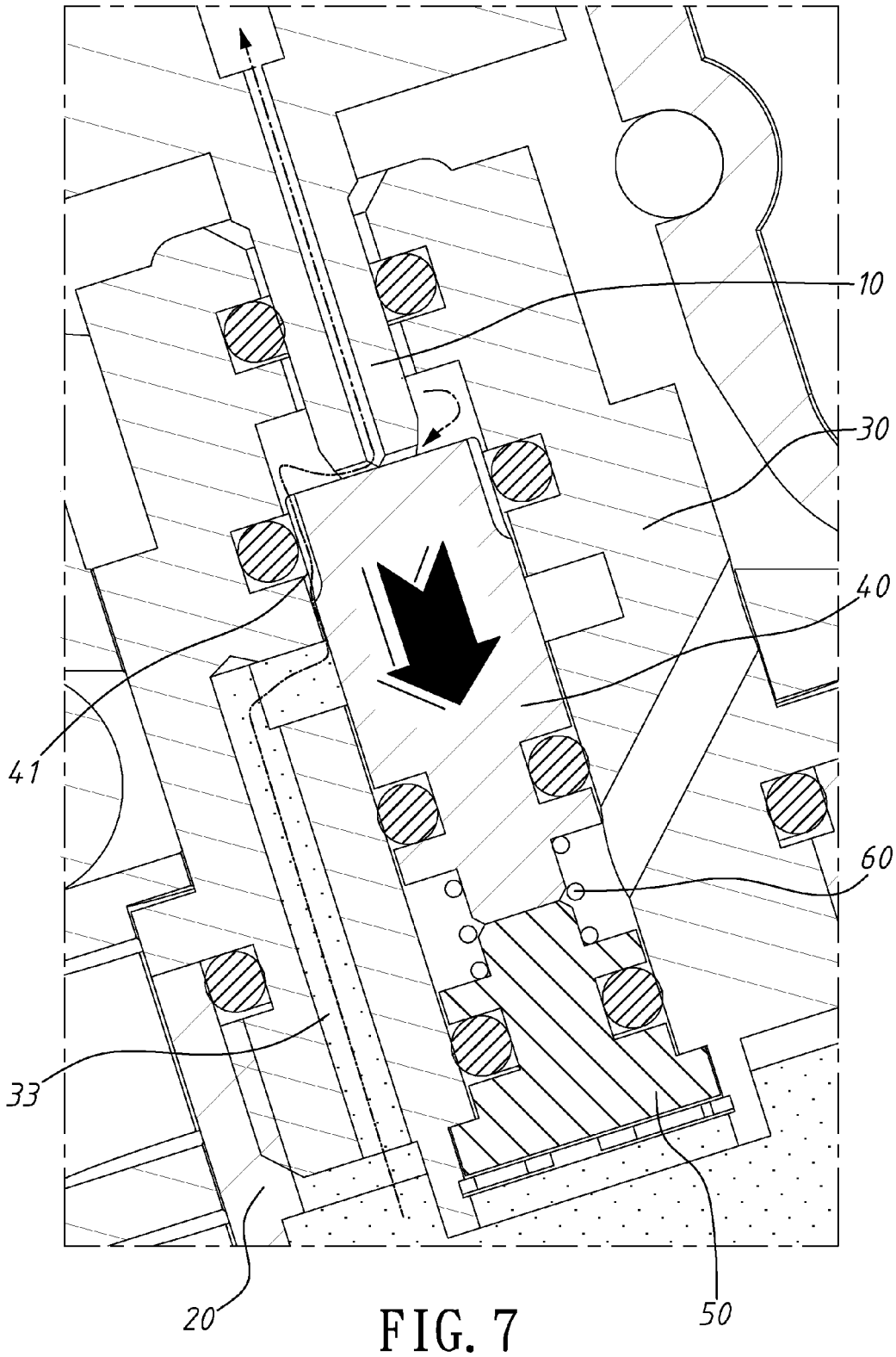
FIG. 7 is a further enlarged view of FIG. 6.

Referring to FIGS. 1 to 8, an air pistol 1 in accordance with the invention comprises the following components as discussed in detail below.

A gas cartridge 2 is filled with high pressure air and comprises a reservoir 20 and internal threads 21 at a top opening of the reservoir 20. A valve 3 is mounted on the top opening of the gas cartridge 2 and comprises a housing 30, a lengthwise central channel 31, an externally threaded lower portion 301 adapted to secure to the internal threads 21, an annular trough 38 above the externally threaded lower portion 301, a flexible sealing ring 39 put on the trough 38, and an inclined tunnel 390 having one end communicating with the channel 31 and the other end terminated at an outer surface of the housing 31. The tunnel 390 can allow air to exit out of the valve 3.

The valve 3 further comprises an enlarged opening 310 on a bottom end of the channel 31 and adjacent the externally threaded lower portion 301, an annular trough 311 on an inner surface of the opening 310, an outlet 32 on a top opening of the channel 31, an annular first depression 34 on an inner surface of the channel 31 adjacent the outlet 32, a flexible first O-ring 35 disposed in the first depression 34, an annular second depression 36 on the inner surface of the channel 31 under the first depression 34, a flexible second O-ring 37 disposed in the second depression 36, and an inverted L-shaped passage 33 having an elongated portion parallel to the channel 31 and a short portion communicating the channel 31.

A plunger 40 is slidably disposed in the valve 3 and comprises a plurality of upper outlets 41, a lower, annular depression 42, an O-ring 43 put on the depression 42, and a cylindrical bottom protrusion 44. The second O-ring 37 clamps on an outer surface of the plunger 40. The O-ring 43 clamps on an inner surface of the channel 31.

A lower sealing member 50 is provided below the plunger 40 by a distance and is in the channel 31. The sealing member 50 comprises a top projection 51, an annular first trough 55 on an intermediate portion of its outer surface, a flexible sealing ring 56 put on the first trough 55, a lower enlargement 52, an annular second trough 53 on a bottom and adjacent the enlargement 52, and a C-ring 54 put on the second trough 53 and urging against the annular trough 311 for securing the sealing member 50 to the valve 3.

A helical spring 60 has both ends put on the protrusion 44 and the projection 51 respectively so that the plunger 40 may slide with respect to the fixed lower sealing member 50 (i.e., the lower sealing member 50 fastened in a lower portion of the channel 31) when the spring 60 is compressed or expanded.

A needle shaped hollow connector 10 is provided on an upper portion of a hollow butt of the air pistol 1. The hollow connector 10 is inserted into the outlet 32 to push the plunger 40 downward with the spring 60 being compressed. Thus, a fluid path (see arrow in FIGS. 6 and 7) from the high pressure air in the reservoir 20 to a trigger mechanism of the air pistol 1 via the passage 33, the outlets 41, the channel 31, and the hollow connector 10 is created. The air pistol 1 is thus ready to fire.

While the invention has been described in terms of preferred embodiments, those skilled in the art will recognize that the invention can be practiced with modifications within the spirit and scope of the appended claims.

What is claimed is:

1. An air pistol comprising:

a gas cartridge comprising a reservoir and upper internal threads;

a valve comprising lower external threads releasably secured to the internal threads, a lengthwise central channel, an inclined tunnel having one end communicating with the channel and the other end terminated at an outer surface of the valve, and an inverted L-shaped passage communicating with the channel;

a spring actuated plunger slidably disposed in the valve and comprising at least one upper outlet;

a sealing member disposed under the plunger and fastened in the channel; and an elongated, hollow connector disposed in the air pistol and inserted into the channel to push the plunger toward the sealing member so as to create a fluid path from the reservoir, the passage, the at least one upper outlet, and the channel to the hollow connector.

2. The air pistol of claim 1, wherein the valve further comprises a lower annular depression on an inner surface of the channel, and wherein the sealing member comprises an annular trough on a bottom, and a C-ring put on the annular trough and urging against the lower annular depression for securing the sealing member to the valve.

* * * * *